US006062152A

United States Patent [19]

Yu et al.

[11] Patent Number: 6,062,152

[45] Date of Patent: May 16, 2000

[54] AUTOMATIC THREAD CUTTING DEVICE FOR AN EMBROIDERY MACHINE

[75] Inventors: Su Jiang Yu; Hao Wang; Nu Ping Yang, all of Tsuen Wan, The Hong Kong Special Administrative Region of the People's Republic of China

[73] Assignee: Capital Automation Co., Ltd., Tsuen Wan, The Hong Kong Special Administrative Region of the People's Republic of China

[21] Appl. No.: 09/076,006

[22] Filed: May 12, 1998

[51] Int. Cl.[7] ..... D05B 65/00

[52] U.S. Cl. ..... 112/291

[58] Field of Search ..... 112/285, 286, 112/291, 292; 83/910

[56] References Cited

U.S. PATENT DOCUMENTS

| | | | |
|---|---|---|---|
| 4,455,957 | 6/1984 | Vollmar | 112/292 |
| 4,589,362 | 5/1986 | Dusch | 112/292 |
| 5,005,504 | 4/1991 | Albrecht et al. | 112/291 X |
| 5,154,130 | 10/1992 | Gribetz et al. | 112/292 |
| 5,375,546 | 12/1994 | Butzen et al. | 112/292 |

*Primary Examiner*—Ismael Izaguirre

*Attorney, Agent, or Firm*—Banner & Witcoff, Ltd.

[57] ABSTRACT

An automatic thread cutting device for cutting upper and lower threads in motorized and/or computer-operated embroidery and sewing machines. The thread cutting device includes a fixed knife for the upper thread and a movable knife for the lower thread. The movable knife includes a deflector for making the upper thread taut and cutting surface for actually cutting the lower thread. After the lower thread is cut, the movable knife is withdrawn and the upper thread is relaxed so that it can be cut by the fixed knife.

10 Claims, 4 Drawing Sheets

AUTOMATIC THREAD CUTTING DEVICE FOR AN EMBROIDERY MACHINE

CROSS REFERENCE TO RELATED APPLICATION

The present application claims the priority of Chinese Application No. 97 2 17548.2 filed May 12, 1997.

BACKGROUND OF THE INVENTION

The present invention relates generally to the field of sewing machines and related devices. More particularly, the invention is directed to an automatic thread cutting attachment for motorized and/or computer-operated embroidery and sewing machines.

Most thread cutting devices known in the prior art for motorized embroidery and sewing machines are formed of at least one cutting blade or curve-line cutting structure. The design of these prior art cutting devices have proved to be deficient in a number of areas. The deficiencies often manifest themselves while the embroidery machine is in operation and include the thread becoming caught in the machine or the ends of the thread being too long, thus causing the thread to catch in the stitches. These problems all affect the automatic and consistently even operation of the machine and often result in less than desirable embroidery and sewing results.

Accordingly, there is a great need in the art for a more effective thread cutting device which eliminates or greatly reduces the disadvantages of current thread cutting device designs.

SUMMARY OF THE INVENTION

Accordingly, it is an object of the present invention to obviate the above-noted shortcomings and disadvantages of thread cutting devices known in the prior art.

It is a further object of the present invention to provide a thread cutting device which can be automatically operated without user intervention It is a still further object of the present invention to provide a thread cutting device which economical to manufacture and simple in operation.

It is a further object of the present invention to provide a thread cutting device which is self-contained and is not reliant on outside systems for its operation.

It is a still further object of the present invention to provide a thread cutting device which is low in cost to manufacture and can be readily installed in existing embroidery and sewing machine designs (with minor modifications).

It is another object of the present invention to provide a thread cutting device which may be readily used with computer controlled embroidery and sewing machines.

It is a still further object of the present invention to provide a thread cutting device which is capable of simultaneous operation with embroidery and sewing machines.

BRIEF DESCRIPTION OF THE DRAWINGS

The novel features of the present invention are set out with particularity in the appended claims, but the invention will be understood more fully and clearly from the following detailed description of the invention as set forth in the accompanying drawings in which:

BRIEF DESCRIPTION OF THE PREFERRED EMBODIMENT

A preferred embodiment of the present invention will now be described with reference to the accompanying drawing.

Figure 1:
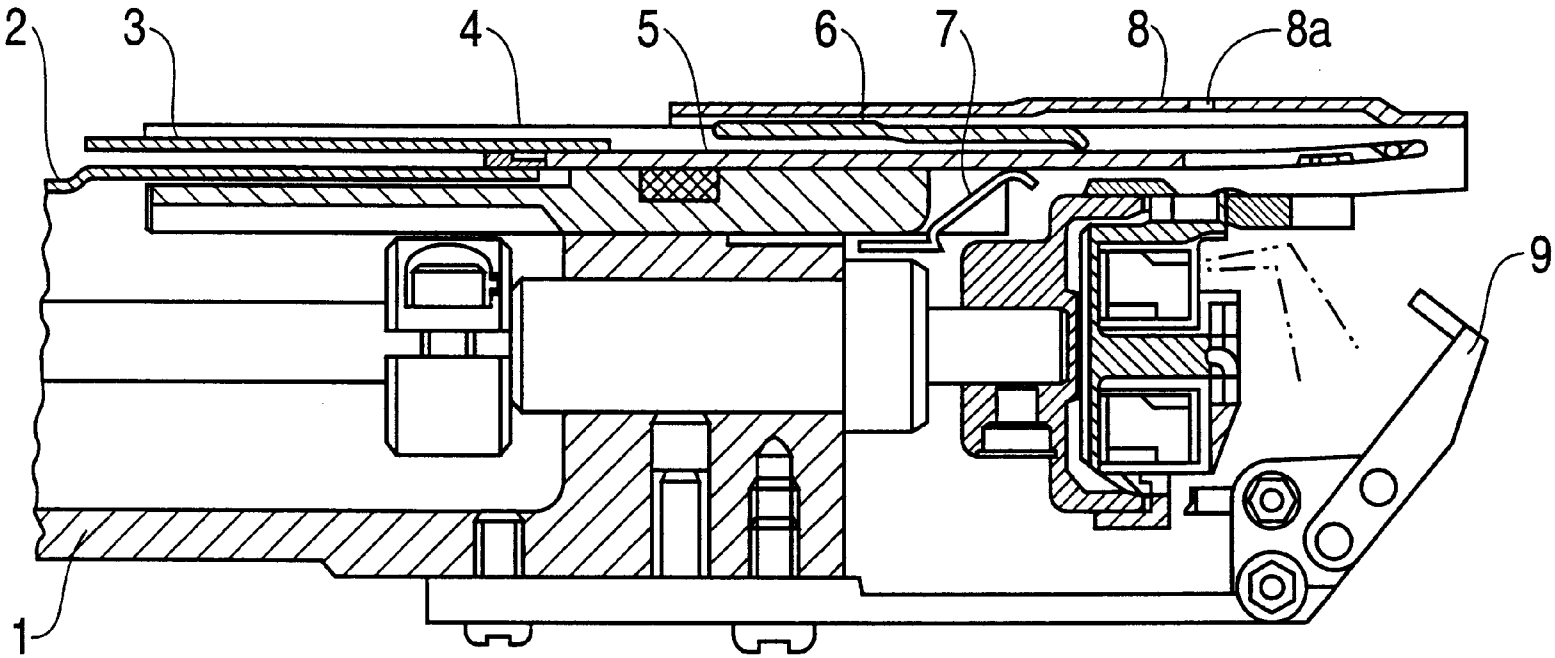
FIG. 1 is a side elevation of the cross-section of the automatic thread cutting device of the present invention.
Figure 2:
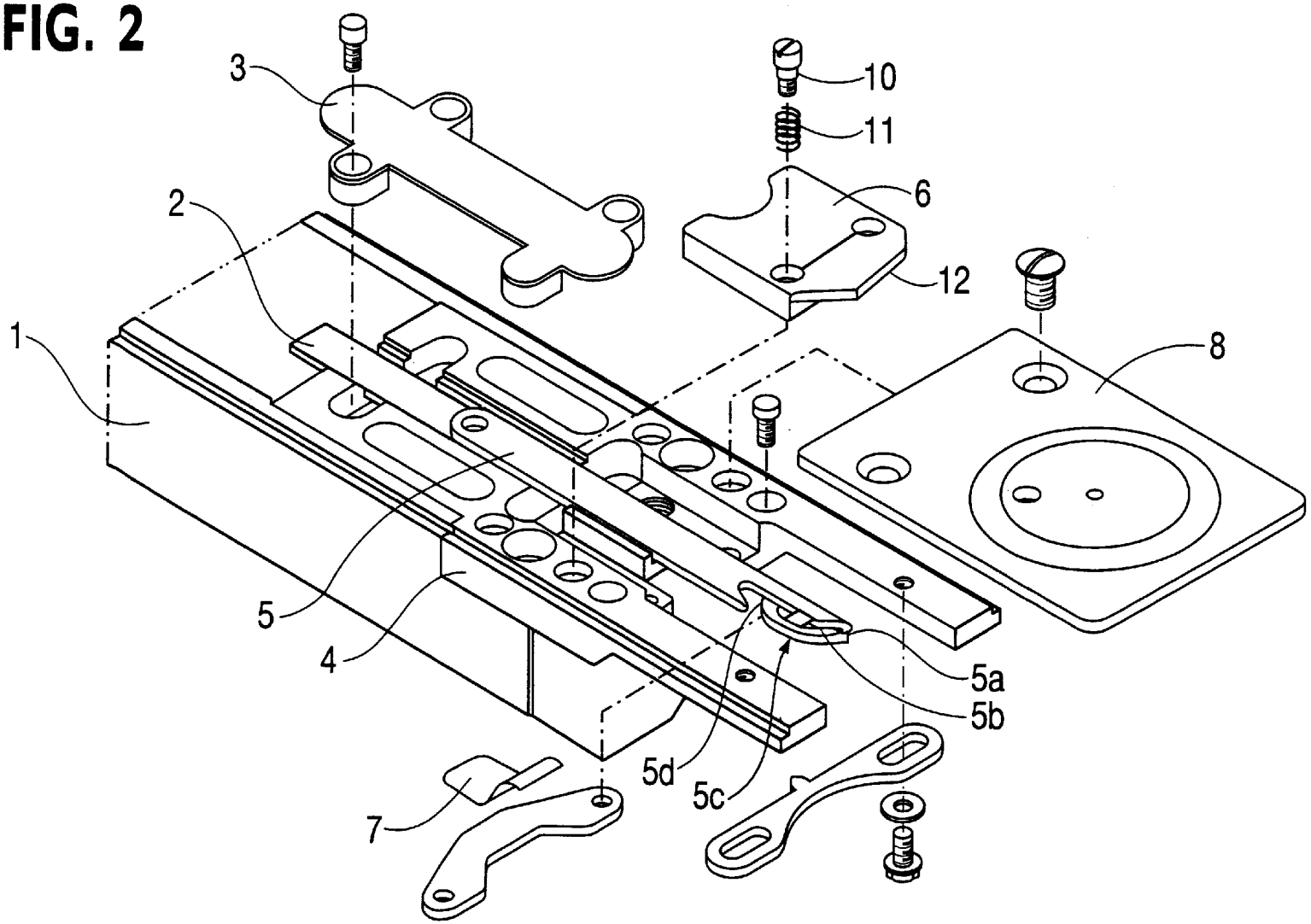
FIG. 2 is a dissected illustration of the automatic thread cutting device of the present invention.

As shown in FIG. 1 and FIG. 2, the thread cutting device of the present invention is attached to needle plate support 4 on an embroidery or sewing machine platform 1. The device is secured with fixed knife 6 on needle plate support 4 and operates with movable knife 5. Operating in conjunction with the sewing movement of the machine, thread cutting is achieved with the opposite movement of fixed knife 6 and movable knife 5 on the sewing thread (upper thread) as the lower thread passing through needle plate hole 8*a*.

The head of the movable knife 5 is formed by a fork, blade, groove, a curling edge, as illustrated in FIG. 2 with respect to reference numbers 5*a*, 5*b*, 5*c* and 5*d*. During the continuous rotary action of the embroidery machine, the movable knife can simultaneously separate a thread, deliver a thread, trim a thread, hook a thread and cut a thread as in FIGS. 3 to 7. At the same time, the lower part of the movable knife can install a thread catcher 7 fixed at the needle plate support, allowing the lower thread to be gently held after cutting and thus ensuring the smooth delivery of the lower thread to subsequent embroidered patches.

At the lower part of the machine platform, there is a thread looping hook 9. During operation, hook 9 holds the upper thread and keep it under the needle plate in preparation for cutting by the movable knife.

The automatic threading device of the present invention may be installed in the following manner.

Using screws 10 and spring 11, fixed knife 6 is secured onto handle plate support plate 4. Movable knife 5 is then placed through the slot of the needle plate support beneath the fixed knife 6 so that movable knife 5 can move freely inside the slot. Thread catcher 7 is then affixed underneath the movable knife 6. Plate 3 is then attached to the back of the needle plate. Inside of machine platform 1, a bobbin 13, which has a lower thread T, is installed in the conventional manner. Thread looping hook 9 is then secured on the bottom of the machine platform. The needle plate support 4, installed with fixed knife 5, movable knife 6 and thread catcher 7 and adjusted, are secured by screws to machine platform 1. Needle plate 8 is then secured on the needle plate support and the back of movable knife 6 is secured to knife drive shaft 2. Finally, upper thread M is threaded through the sewing needle.

The operation of the thread cutting device will now described with reference to FIG. 3–7. These Figures illustrate the 5 basic steps of the operation.

Figure 3:
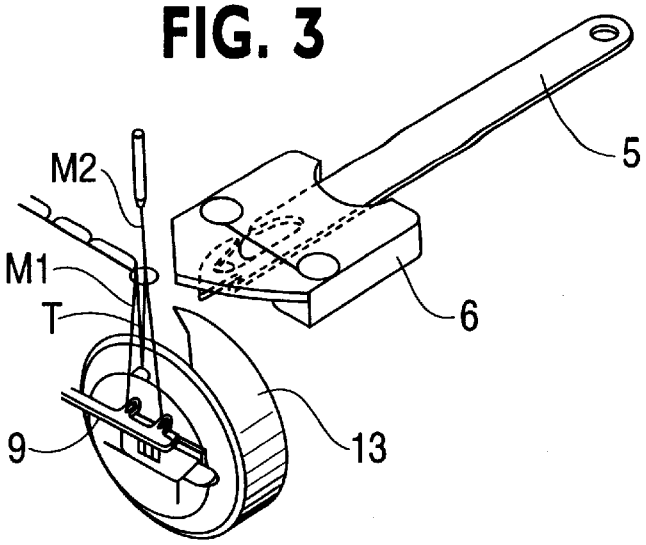
FIGS. 3 to 7 illustrate the sequence of operation of the thread cutting device of the present invention.
Figure 4:
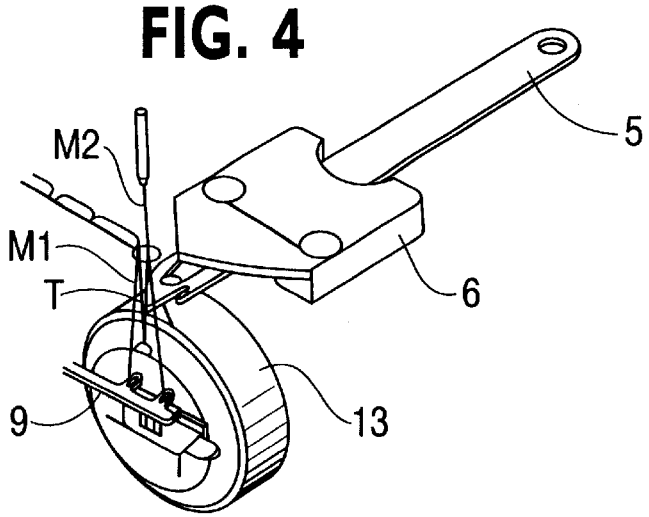
Figure 5:
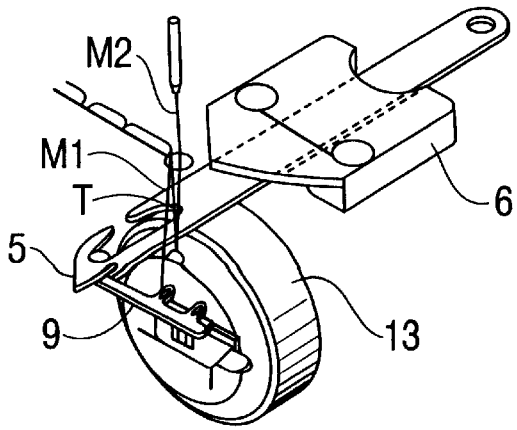

When thread cutting is required, the needle, starting from the last stitch, enters the front of rotary hook of bobbin 13 through needle plate hole 8*a*. Thread looping hook 9 moves to a working position, keeping the upper thread from being pulled upwards. Upper thread M is then divided into two upper thread M1 and M2 as shown in FIG. 3. M1 is linked with the cloth being sewn. M2 is linked to the needle. At this time, movable knife 5 is then moved forward by knife drive shaft 2 as shown in FIG. 4. Upper thread M2, which is not cut, is moved aside by fork 5*a*. The other upper thread M1 and lower thread T slide into groove 5*d* along curling edge 5*c* as illustrated in FIG. 5. When movable knife 5 swings back, upper thread M2, pushed out by fork, is loosened. This makes the upper thread slack before cutting (after upper thread M1 is cut, thus the thread will not spring out of the eye of the needle due to tightness of the thread).

Figure 6:
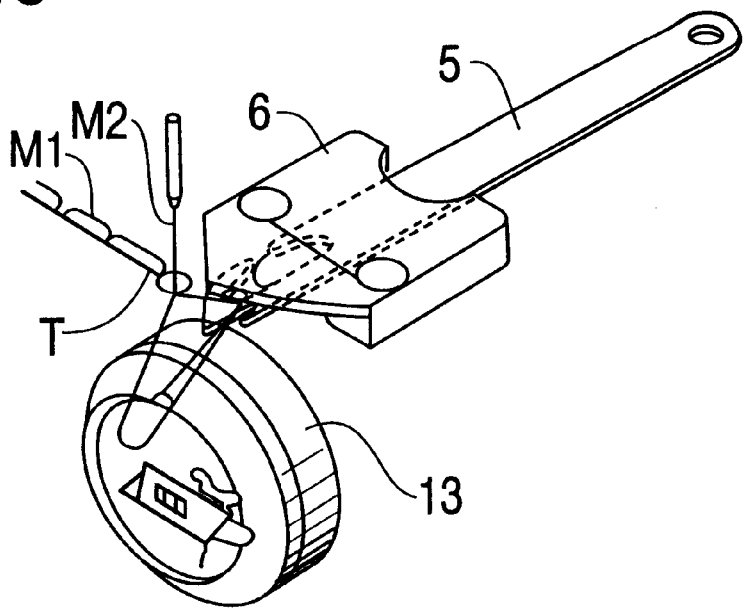
Figure 7:
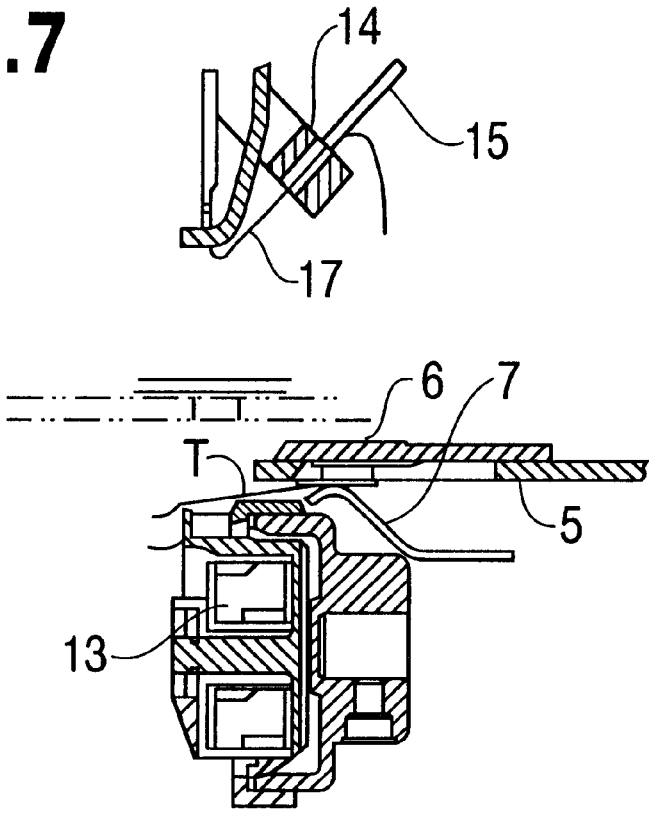

Upper thread M1 and lower thread T, now in groove 5*d*, are cut at 5*b* by movable knife 5 and fixed knife 6 when they meet at blade 12 as illustrated in FIG. 6. The cut upper thread is lifted by up-take lever 15 and adhered to thread hook spring 14. The lower thread is then held lightly by thread catcher 7. Its function is to let the lower thread be easily hooked by the upper thread in the following embroidery operation and form a threading knot as illustrated in FIG. 7.

The automatic thread cutting device of the present invention has a very efficient design, using the reciprocating movement of movable knife 5 and fixed knife 6. It takes advantage of the spacious rotary hook base in the sewing head of the embroidery or sewing machine and eliminates the problematic effects caused by loose thread ends which are a direct result of repeated thread cutting during high-speed operation of the machine.

The entire thread cutting combination is a stand-alone system. It works closely with the operation of embroidery or sewing machine. It can support a variety of models of embroidery and sewing machines, including: single head and multi needles; multi-head and multi needle and multi colors etc.

The device is especially suited to computer-operated high-speed embroidery and sewing machines. It can follow instructions coming issued from the computer and performs the required thread cutting jobs under conditions of color switching, pattern switching and cap frame-switching, etc. It can perform the thread cutting jobs efficiently and selectively, thus enhancing product quality and working efficiency.

It should be obvious from the above-discussed apparatus embodiment that numerous other variations and modifications of the apparatus of this invention are possible, and such will readily occur to those skilled in the art. Accordingly, the scope of this invention is not to be limited to the embodiment disclosed, but is to include any such embodiments as may be encompassed within the scope of the claims appended hereto.

We claim:

1. A thread cutting device for a sewing machine having an upper thread and a lower thread, said device comprising:

movable knife means and fixed knife means for cutting said upper and lower threads;

carriage means for carrying said movable knife means between a cutting position and a home position; and wherein said movable knife means includes:

thread deflector means for making a portion of said upper thread taut as said movable knife means is carried into said cutting position by said carriage means; and thread capture means for capturing said lower thread as said movable knife means is carried into said cutting position by said carriage means, said upper and lower threads being cut by said fixed knife means and said movable knife means as said movable knife means is returned to its home position by said carriage means.

2. The thread cutting device of claim 1, wherein said thread deflector means is generally u-shaped in construction.

3. The thread cutting device of claim 1, wherein said thread capture means is generally slot-shape in construction with an opening in one side through which said lower thread passes.

4. The thread cutting device of claim 3, wherein a portion of said one side of said thread capture means is generally shaped to provide a cam-follower function for said lower thread leading to said opening.

5. The thread cutting device of claim 4, wherein said thread capture means include thread cutting means for cooperating with said fixed knife means to cut said upper and said lower threads when said movable knife means is returned to its home position by said carriage means.

6. The thread cutting device of claim 5, wherein said upper thread is released from being taut as said movable knife means is returned to its home position.

7. A thread cutting device for a sewing machine having an upper thread and a lower thread, said device comprising:

movable knife means and fixed knife means for cutting said upper and lower threads;

carriage means for carrying said movable knife means between a cutting position and a home position; and wherein said movable knife means includes:

thread deflector means for making said upper thread taut as said movable knife means is carried into said cutting position by said carriage means; and thread capture means for capturing said lower thread as said movable knife means is carried into said cutting position by said carriage means and cutting said lower thread as said movable knife means is returned to its home position by said carriage means.

8. The thread cutting device of claim 7, wherein said thread capture means is generally slot-shape in construction with an opening in one side through which said lower thread passes, wherein a portion of said one side is generally shaped to provide a cam-follower function for said lower thread leading to said opening.

9. The thread cutting device of claim 8, wherein said thread capture means include thread cutting means for cooperating with said fixed knife means to cut said upper and lower threads when said movable knife means is returned to its home position by said carriage means.

10. The thread cutting device of claim 9 wherein said upper thread is released from being taut as said movable knife means is returned to its home position.

* * * * *